United States Patent [19]

Lewis

[11] Patent Number: 4,657,407

[45] Date of Patent: Apr. 14, 1987

[54] CLOCK CONSTRUCTION AND METHOD OF MAKING THE SAME

[75] Inventor: Jay L. Lewis, Knox County, Tenn.

[73] Assignee: Robertshaw Controls Company, Richmond, Va.

[21] Appl. No.: 651,573

[22] Filed: Sep. 17, 1984

[51] Int. Cl.[4] ..... G04B 17/02

[52] U.S. Cl. ..... 368/184; 368/185; 368/190; 368/89

[58] Field of Search ..... 368/184–199, 368/89–112

*Primary Examiner*—Bernard Roskoski

*Attorney, Agent, or Firm*—Candor, Candor & Tassone

[57] ABSTRACT

A clock construction and method for making the same are provided, the clock construction comprising a frame, an interval timer carried by the frame, and a selector shaft rotatably carried by the frame while being axially movable relative thereto and being operatively interconnected to the timer to set the same to a selected time period upon rotation of the selector shaft. The timer has a cam member rotatably disposed on the shaft and has a slot in one side thereof. The shaft has a drive member disposed in the slot to rotate the cam member in unison with rotation of the shaft in any axial position of the shaft. A spring is disposed between the frame and the drive member to tend to maintain the shaft in one axial position thereof. The spring is confined completely within the slot of the cam in all axial positions of the shaft relative to the frame.

26 Claims, 15 Drawing Figures

CLOCK CONSTRUCTION AND METHOD OF MAKING THE SAME

BACKGROUND OF THE INVENTION

1. Field of the Invention

This invention relates to a new clock construction having an interval timer means and to a method of making such a clock construction.

2. Prior Art Statement

It is known to provide a clock construction comprising a frame means, an interval timer means carried by the frame means, and a selector shaft means rotatably carried by the frame means while being axially movable relative thereto and having interconnection means operatively interconnected to the timer means to set the same to a selected time period upon rotation of the selector shaft means. The timer means comprises a cam member rotatably disposed on the shaft means and has a drive slot means in one side thereof. The interconnection means of the shaft means comprises a drive member carried thereby and being disposed in the slot means to rotate the cam member in unison with rotation of the shaft means in any axial position of the shaft means. A spring means is disposed between the frame means and the drive member to tend to maintain the shaft means in one axial position thereof, the spring means comprising a coiled compression spring. For example, see U.S. Pat. No. 3,694,591 to Bassett et al.

Such a prior known clock construction also has a time of day clock means carried by the frame means and the selector shaft means is a single selector shaft means that has another interconnection means operatively interconnected to the clock means to set the time thereof upon rotation of the selector shaft means while in a certain axial position thereof relative to the frame means.

SUMMARY OF THE INVENTION

It is one feature of this invention to provide a new clock construction having an interval timer means wherein the thickness of the clock construction is maintained as small as possible.

In particular, it was found according to the teachings of this invention that the spring means that is utilized to maintain the selector shaft means of a clock construction in the normal out axial position thereof could be uniquely formed so as to be confined completely within the slot means of the cam means that is carried by the selector shaft means in all of the axial positions of that selector shaft means relative to the frame means of the clock construction in contrast to the prior known arrangement where the spring means extend beyond the slot means of the cam means in order to provide a sufficient length of the spring means for its intended purpose.

For example, one embodiment of this invention provides a clock construction comprising a frame means, an interval timer means carried by the frame means, and a selector shaft means rotatably carried by the frame means while being axially movable relative thereto and having interconnection means operatively interconnected to the timer means to set the same to a selected time period upon rotation of the selector shaft means. The timer means comprises a cam member rotatably disposed on the shaft means and having a drive slot means in one side thereof. The interconnection means of the shaft means comprises a drive member carried thereby and being disposed in the slot means to rotate the cam member in unison with rotation of the shaft means in any axial position of the shaft means. A spring means is disposed between the frame means and the drive member to tend to maintain the shaft means in one axial position thereof, the spring means being confined completely within the slot means of the cam means in all axial positions of the shaft means relative to the frame means.

Accordingly, it is an object of this invention to provide a new clock construction having one or more of the novel features of this invention as set forth above or hereinafter shown or described.

Another object of this invention is to provide a new method of making such clock construction, the method of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

DESCRIPTION OF THE PREFERRED EMBODIMENT

Figure 1:
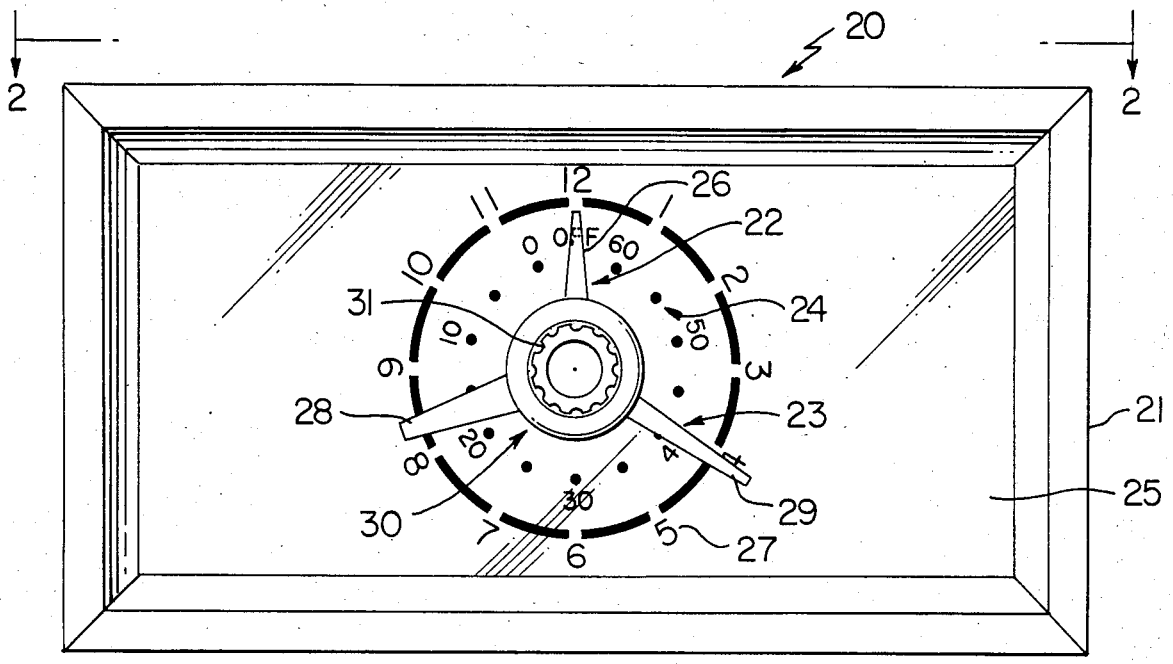
FIG. 1 is a front view of the new clock construction of this invention.

While the various features of this invention are hereinafter illustrated and described as providing an analog clock construction, it is to be understood that the various features of this invention can be utilized singly or in any combination thereof to provide other types of clock constructions, such as a digital clock construction.

Also, while various parts of the clock construction are illustrated as being formed of metallic material, it is to be understood that other suitable materials or combination of suitable materials can be utilized.

Therefore, this invention is not to be limited to only the embodiment illustrated in the drawings, because the drawings are merely utilized to illustrate one of the wide variety of uses of this invention.

Referring now to FIGS. 1–4, the new clock construction of this invention is generally indicated by the reference numeral 20 and comprises a frame means 21 carrying an interval timer means that is generally indicated by the reference numeral 22 and a time of day clock means that is generally indicated by the reference numeral 23, the interval timer means 22 including a 60 minute scale 24 disposed on a viewable dial or display plate 25 and a pointer 26 movable over the scale 24 in a manner hereinafter set forth and the time of day clock means comprising an hour scale 27 also disposed on the viewable dial or display plate 25 in a concentric manner and outboard of the timer scale 24 and an hour hand 28 and a minute hand 29 both being rotatable over the hour scale 27 in the manner hereinafter set forth.

The frame means 21 rotatably carries a single selector shaft means that is generally indicated by the reference numeral 30 and has a control knob 31 on the outer end 32 thereof and being located externally of a transparent panel 33 carried by the frame means 21 and disposed in front of the display plate 25 in a conventional manner, the selector shaft means 30 also being axially movable relative to the frame means 21 for a purpose hereinafter set forth.

Figure 14:
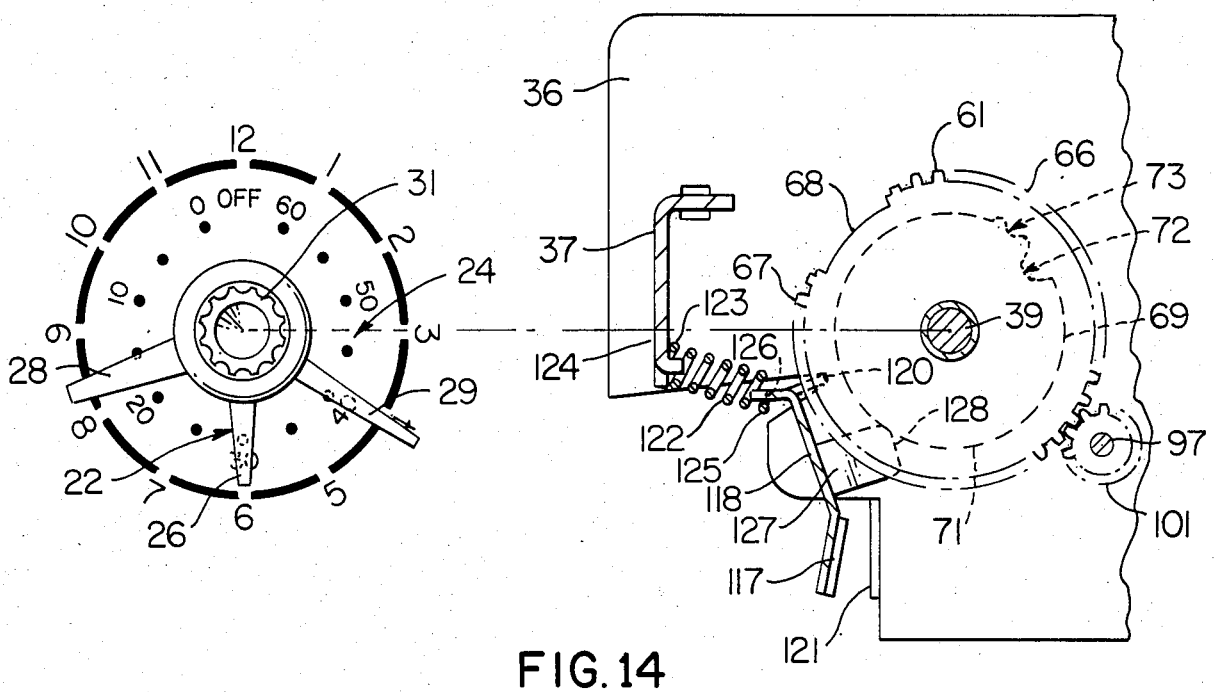
FIG. 14 is a fragmentary view similar to FIG. 6 and illustrates the position of the cam means when the timer means is operating in a time set manner.
Figure 15:
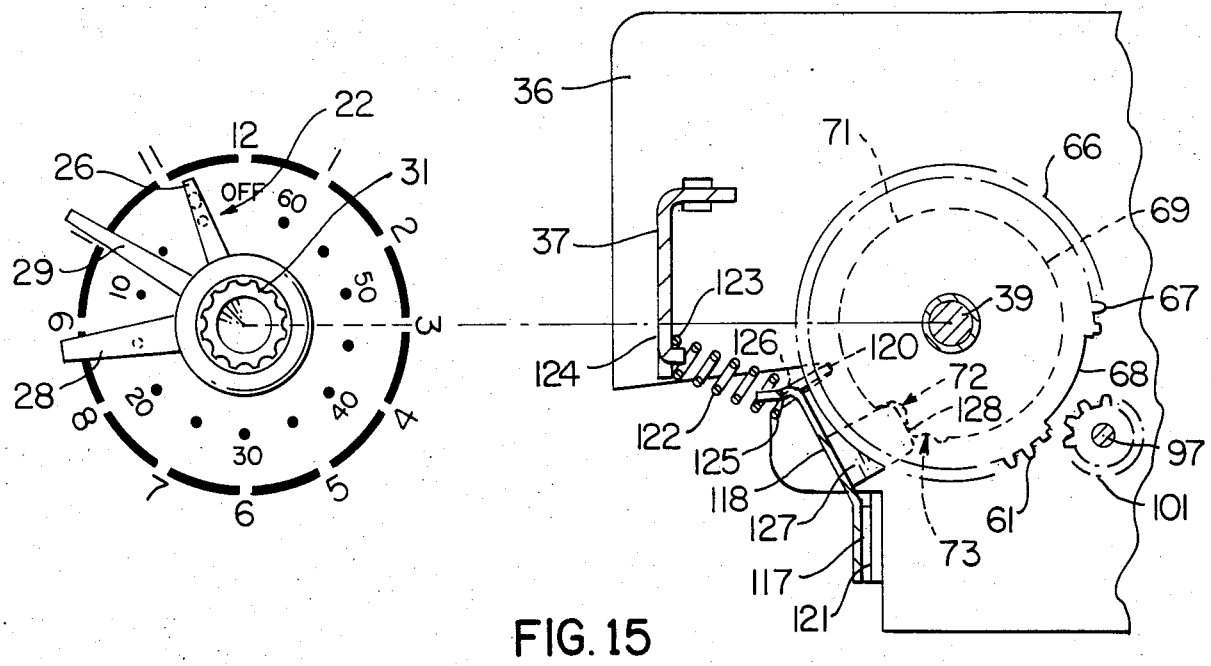
FIG. 15 is a view similar to FIG. 14 and illustrates the condition of the clock construction when the timer means has completed its time period of operation.

In this manner, an operator can grasp the control knob 31 and by rotating the same in either a clockwise or a counterclockwise direction can set the pointer 26 of the interval timer 22 to any desired time period by positioning the pointer 26 over the desired time indication of the scale 24, such a "30" minutes as illustrated in FIG. 14, so that the clock construction 20 will thereafter cause the pointer 26 to rotate in a timed manner and in a clockwise direction in FIG. 1 from the initial set time period thereof to the "0" time period thereof as illustrated in FIG. 15 and cause a signal, such as an alarm to operate indicating that the selected time period has lapsed as will be apparent hereinafter. Thereafter, the operator turns the control knob 31 to position the pointer 26 from the "0" position of FIG. 15 back to the "OFF" position of FIG. 1 to terminate the operation of the alarm as will also be apparent hereinafter.

Figure 8:
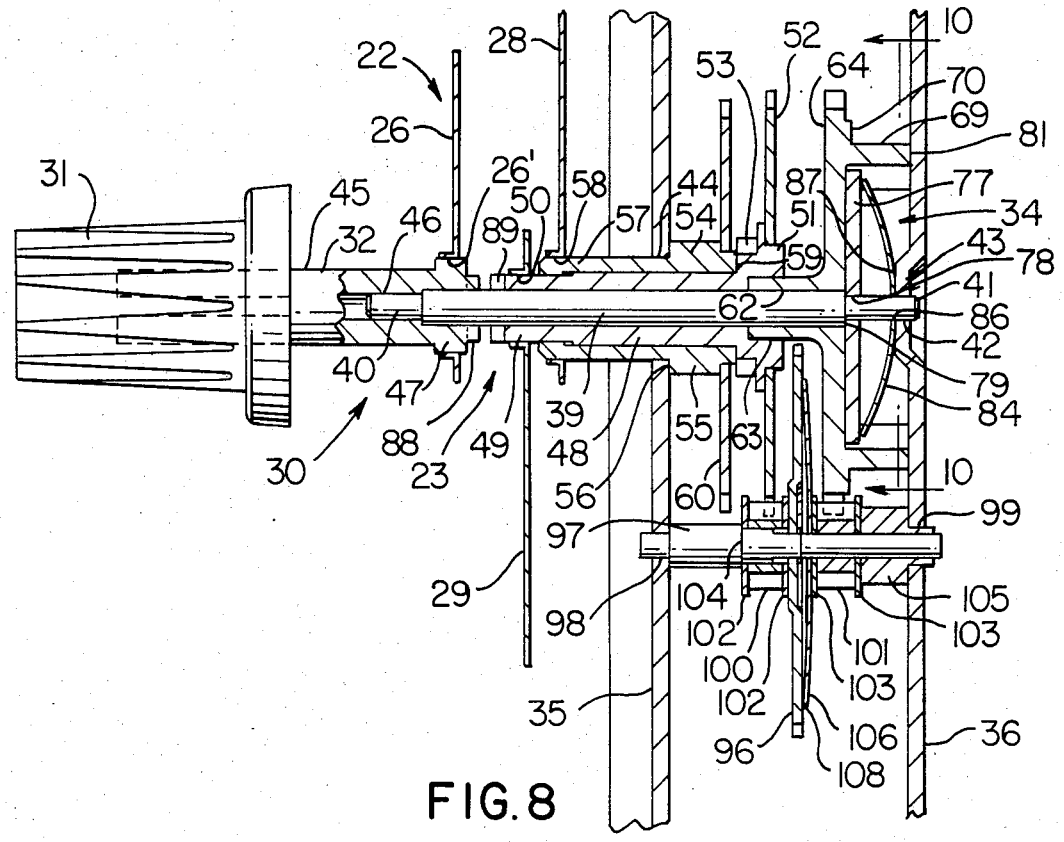
FIG. 8 is an enlarged fragmentary cross-sectional view taken on line 8—8 of FIG. 6.
Figure 9:
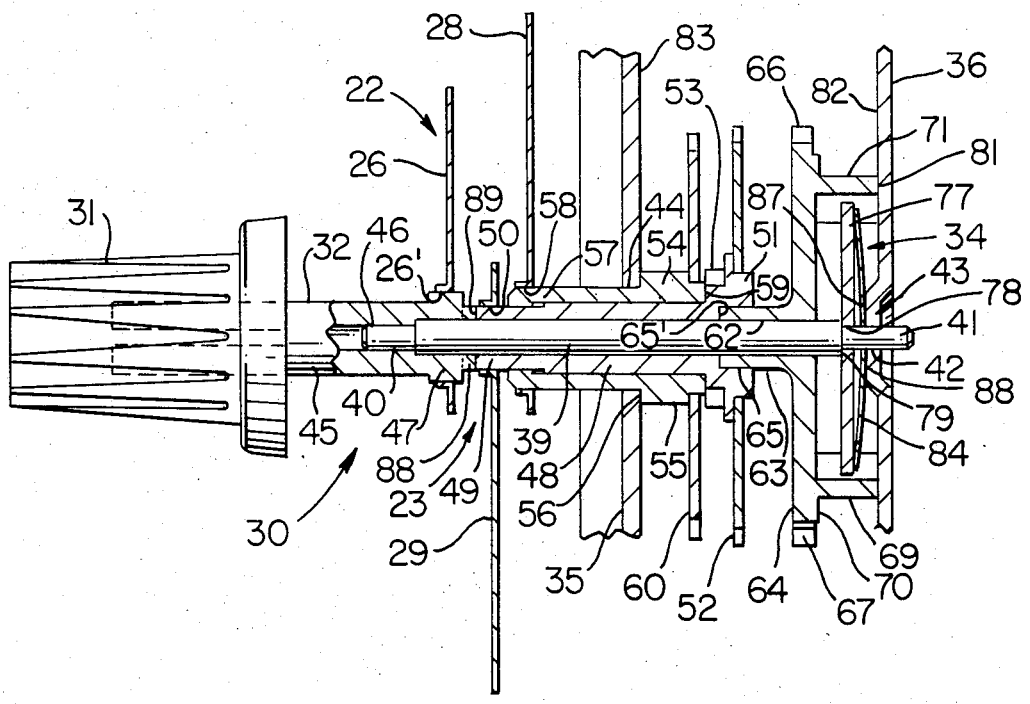
FIG. 9 is a view similar to FIG. 8 and illustrates the selector shaft means in another axial position thereof.
Figure 11:
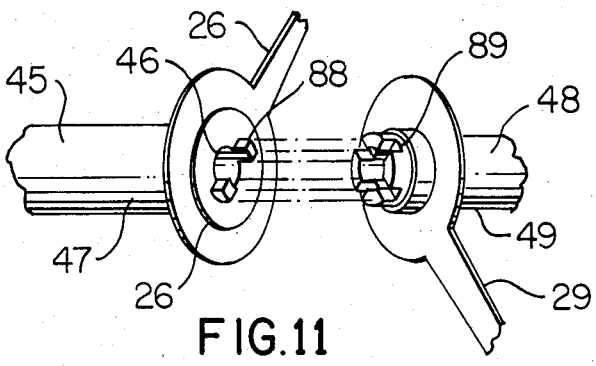
FIG. 11 is a fragmentary exploded perspective view of certain parts of the selector shaft means of the clock construction of FIG. 1.

Should the operator desire to set the time of day clock means 26 to another time thereof, such as for correcting the time setting thereof, the operator grasps the control knob 31 and moves the selector shaft 30 axially inwardly from the normal out position illustrated in FIG. 8 to its axial in position as illustrated in FIG. 9 and then rotates the control knob 31 in such in axial position of FIG. 9 in either a clockwise or a counterclockwise direction to set the hands 28 and 29 to the desired new time setting relative to the time of day scale 27 as will be apparent hereinafter. After the time of day clock means 23 has been so set to the new desired time thereof, the operator merely releases the selector shaft 30 and the same moves axially outwardly from the position illustrated in FIG. 9 back to the position illustrated in FIG. 8 through the force of a spring means that is generally indicated by the reference numeral 34 and operating in a manner hereinafter set forth. Such setting of the time of day clock means 23 through rotation of the selector shaft 30 while in its in axial position of FIG. 9, also causes the interval timer means 22 to have its pointer 26 move with rotation of the selector shaft 30 as will be apparent so that once the time of day clock means 23 has been set at the desired position thereof and the selector shaft 30 has been moved axially outwardly to the position illustrated in FIG. 8 by the spring means 34, the operator then rotates the selector knob 30 in the out axial position of FIG. 8 to cause the pointer 26 of the interval timer means 22 to again be set in the "OFF" position thereof as illustrated in FIG. 1 so as to prevent an inadvertent setting of the interval timer means 22 to a time period setting thereof.

Such general operation of the clock construction 20 is disclosed in the aforementioned patent to Bassett et al, U.S. Pat. No. 3,694,591 whereby this U.S. patent is being incorporated into this disclosure by this reference thereof.

Figure 2:
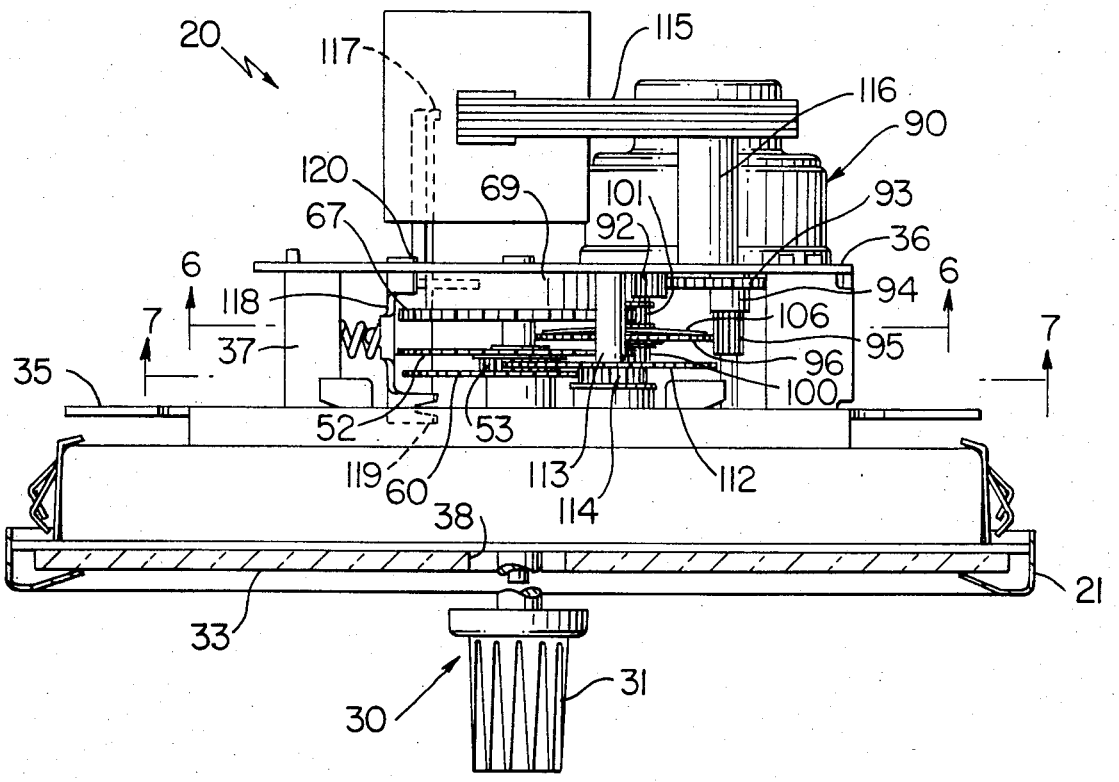
FIG. 2 is a top view of the clock construction in FIG. 1 and is taken in the direction of the arrows 2—2 of FIG. 1.

The frame means 21 of the clock construction 20 includes a front plate member 35 and a rear plate member 36 spaced from each other and secured together by suitable post means 37, FIG. 2, with the front plate means 35 carrying the display plate 25 and transparent panel 33 in front of the same in a conventional manner, the selector shaft means 30 projecting through a suitable opening 38 formed in the transparent panel 33 as illustrated in FIG. 2.

The selector shaft means 30 of the clock construction 20 of this invention comprises a cylindrical member or rod 39 having a pair of opposed reduced ends 40 and 41, the reduced end 41 passing through a suitable opening 42 formed in a portion 43 of the rear frame plate 36 as illustrated so that the portion 43 of the rear frame plate 36 supports one end of the selector shaft means 30 in the clock construction 20. The frame plate 35 has an opening 44 passing therethrough which supports the other end of the selector shaft 30 as will be apparent hereinafter.

The end 32 of the selector shaft means 30 comprises a cylindrical member 46 which has a stepped opening 46 formed in one end 47 thereof and having the end 40 of the cylindrical member or rod 39 secured therein in any suitable manner, such as press-fitting, as illustrated in FIGS. 8 and 9 so that the members 45 and 39 are secured together and will rotate in unison as well as be axially moved in unison as will be apparent hereinafter.

The member 45 of the selector shaft means 30 is press-fitted or otherwise secured in an opening 26' formed through the hand 26 whereby the hand 26 and member 45 rotate in unison for a purpose hereinafter set forth.

A first sleeve 48, hereinafter referred to as a minute sleeve, is rotatably mounted on selector shaft rod 39 and has an end 49 passing through a suitable opening 50 in the minute hand 29 in a press fit manner or the like whereby the minute hand 29 is carried by the sleeve 48 to rotate in unison therewith on the rod 39, the other end 51 of the sleeve 48 having a large pinion gear 52 fixed thereon as well as having a smaller pinion gear 53 formed integrally therewith for a purpose hereinafter described.

A second sleeve 54, hereinafter referred to as an hour sleeve, is rotatably disposed on the minute sleeve 48 and has an enlarged end portion 55 which defines a shoulder 56 that rotatably abuts against the front frame plate 35 as illustrated in FIGS. 8 and 9 while having a reduced end 57 thereof passing through the opening 44 in the plate 35 and being press-fitted or otherwise secured in a suitable opening 58 in the hour hand 28 so that the hour hand 28 is carried by the sleeve 54 to rotate in unison therewith.

The end 55 of the hour sleeve 54 rotatably abuts against a shoulder 59 of the minute sleeve 48 and carries a large pinion gear 60 that rotates in unison with the hour sleeve 54 in a manner hereinafter set forth.

A cam member 61 is rotatably disposed on selector shaft rod 39 by receiving the rod 39 through an opening 62 that passes through the cam member 61 as well as through a tubular extension 63 thereof that extends from one side 64 of the cam member 61, the tubular member 63 being rotatably received in an opening 65 formed in the end 51 of the minute sleeve 48 and rotatably abutting against an internal shoulder 65' of the minute sleeve 48.

Figure 10:
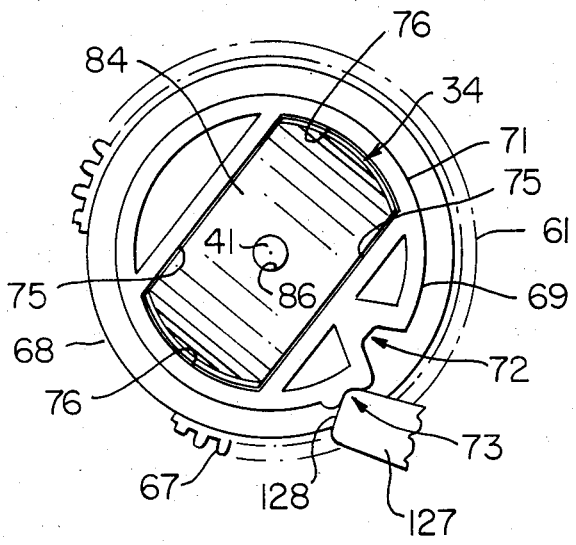
FIG. 10 is a fragmentary cross-sectional view taken on line 10—10 of FIG. 8.
Figure 12:
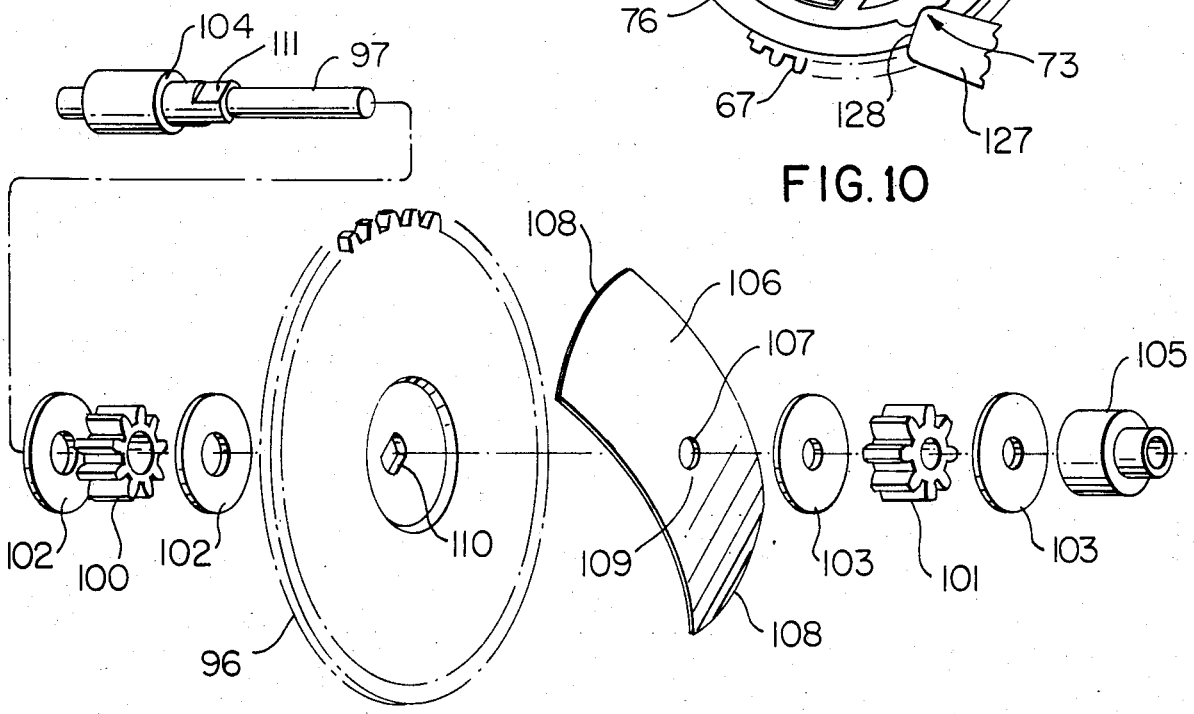
FIG. 12 is an exploded perspective view of the clutch means of the clock construction of FIG. 1.

The cam member or disc 61 has a substantially cylindrical outer periphery 66 that is provided with a plurality of teeth 67 throughout the majority of the outer periphery 66 thereof as illustrated in FIG. 10 whereby a section 68 of the outer periphery 66 is not provided with teeth 67 as illustrated in FIG. 10 for a purpose hereinafter set forth.

A tubular cam structure 69 extends outwardly from the side 70 of the cam member 61 and has an outer peripheral surface 71 that is substantially circular except for a relatively deep cutout 72, FIG. 10, and a relatively small cutout 73 adjacent thereto for a purpose hereinafter set forth.

The tubular projection 69 of the cam member 61 defines a slot means 72 therein which has a substantially rectangular configuration as illustrated in FIG. 10 defined by a pair of opposed substantially straight sides 75 and another pair of opposed sides 76 which are substantially arcuate with the concave portions thereof facing each other.

Figure 13:
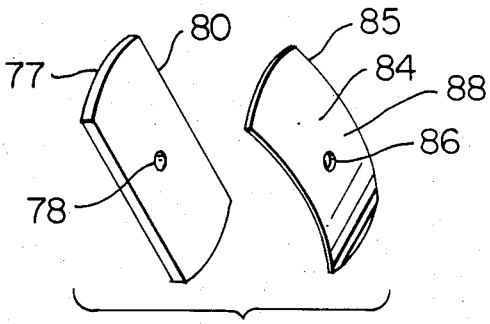
FIG. 13 is a reduced exploded perspective view of the cam drive member and its associated spring means of the clock construction of FIG. 1.

A drive member 77 as best illustrated in FIG. 13 and comprising a substantially flat plate and having an opening 78 passing medially therethrough is telescoped on the reduced end 41 of the selector rod 39 to be secured thereto against a shoulder 79 thereof in any suitable manner, such as by brazing, so that the drive member 77 and rod 39 rotate in unison, the drive member 77 having an outer peripheral surface 80 that has substantially the same configuration as the configuration of the slot means 74 so that the drive member 77 not only rotates in unison with the selector rod 39, but also the drive member 77 rotates in unison with the cam member 61 for a purpose hereinafter set forth while still being axially movable in the slot means 74.

In this manner, the selector shaft means 30 is adapted to be axially moved relative to the cam member 61 as the drive member 77 can axially move in the slot 74 thereof between the positions illustrated in FIGS. 8 and 9 while still drivingly interconnecting the selector shaft 30 with the cam member 61 to rotate in unison therewith for a purpose hereinafter set forth.

The tubular cam means 69 of the cam member 61 has its outer annular surface 81 adapted to abutt against the inside surface 82 of the frame plate 36 so as to rotate relative thereto and maintain the cam member 61, minute sleeve 48 and hour sleeve 54 in the stacked relation between the fixed frame members 35 and 36 while permitting the same to rotate relative thereto.

It was found according to the teachings of this invention that the distance between the inside surfaces 82 and 83 of the frame plates 36 and 35 can be kept at a relatively short dimension if the spring means 34 for the selector shaft means 30 is uniquely formed according to the teachings of this invention.

In particular, the spring means 34 as best illustrated in FIG. 13 comprises a bowed spring member 84 formed of suitable metallic material and having an outer peripheral surface 85 formed with a configuration substantially the same as the configuration of the slot means 74 and the configuration of the outer peripheral surface 80 of the drive member 77 as illustrated in FIGS. 10 and 13, the bowed spring member 84 having an opening 86 passing centrally therethrough and telescopically receiving the reduced portion 41 of the selector rod 39 therethrough as illustrated in FIGS. 8 and 9 whereby it can be seen that the bowed spring member 84 is completely confined within the slot means 74 of the cam member 61 in all axial positions of the selector shaft means 30.

The portion 43 of the end plate 36 is inwardly deformed so as to have its inner surface 87 also disposed within the slot means 74 of the cam member 61 and bears against the medial portion 88 of the bowed spring member 84 as illustrated in FIGS. 8 and 9 in all axial positions of the selector shaft means 30.

Thus, when the selector shaft means 30 is disposed in the out axial position illustrated in FIG. 8, it can be seen that the bowed spring member 84 is still under slight compression between the drive member 77 and the surface 87 of the frame portion 43 so as to tend to maintain the selector shaft means 30 in its normal out axial position. However, when the operator pushes axially inwardly on the control knob 31 to axially move the selector shaft means 30 to the position illustrated in FIG. 9, the bowed spring member 84 is substantially straightened out between the drive member 77 and the surface 87 of the frame plate 36 to permit such axial movement of the selector shaft means 30. However, once the selector shaft means 30 is released from the in axial position illustrated in FIG. 9, the bowed spring member 84 expands to the condition illustrated in FIG. 8 to axially move the selector shaft means 30 outwardly until the drive member 77 abutts against the side 70 of the cam member 61.

The end 47 of the member 45 of the selector shaft means 30 has a pair of outwardly exteneding spline projections 88 on opposite sides of the opening 46 thereof which are adapted to be respectively received in spline notches 89 formed on the end 49 of the minute sleeve 48 only when the selector shaft means 30 has been moved axially inwardly from the position illustrated in FIG. 8 to the position illustrated in FIG. 9 to thereby couple the member 45 of the selector shaft means 30 to the minute sleeve 48 whereby subsequent rotation of the control knob 31 while the selector shaft 30 is in the in axial position of FIG. 9 causes simultaneous rotation of the minute sleeve 48 to thereby set the minute hand 29 and hour hand 28 to the desired position relative to the time of day scale 27 on the dial plate 25 in a manner hereinafter set forth. However, when the selector shaft 39 is released from the in axial position illustrated in FIG. 9, the spring member 84 moves the selector shaft means 30 axially outwardly whereby the spline projections 88 on the end 47 of the member 45 of the selector shaft means 30 are disposed out of splined engagement with the spline notches 89 on the end 49 of the minute sleeve 48 so that rotation of the selector knob 30 while the selector shaft means 30 in in the out axial position of FIG. 8 will not cause rotation of the minute sleeve 48 and, thus, will not cause setting of the time of day clock means 23 but will cause a setting of the interval timer means 22 in a manner hereinafter set forth.

Figure 3:
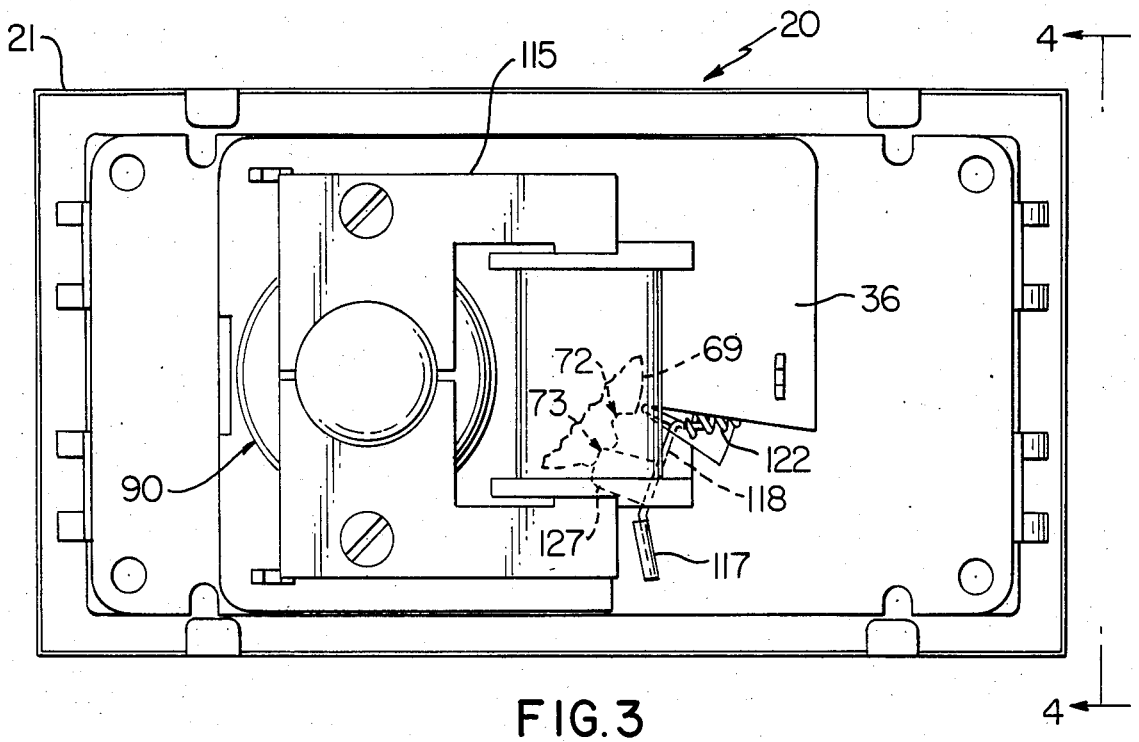
FIG. 3 is a rear view of the clock construction illustrated in FIG. 1.
Figure 4:
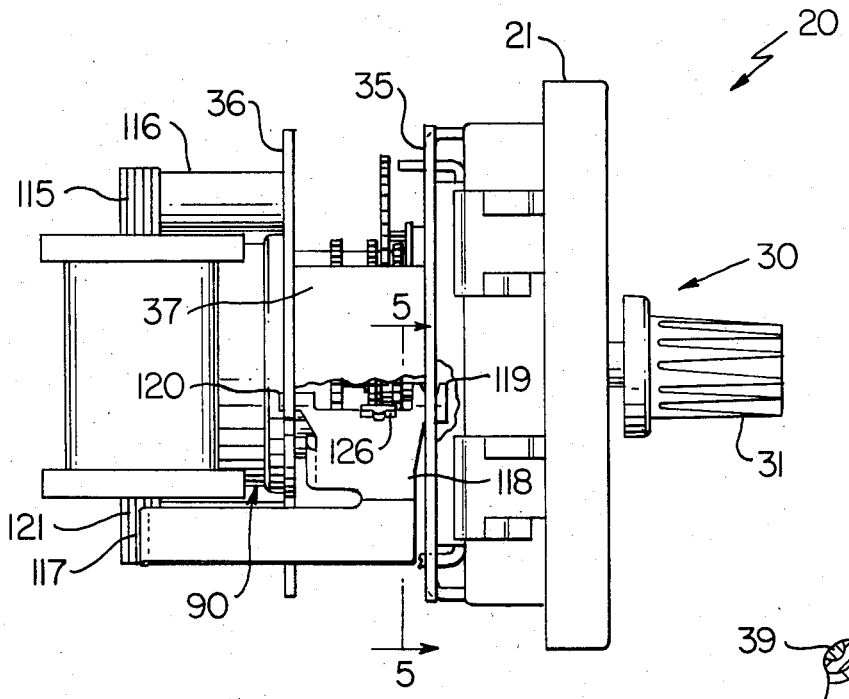
FIG. 4 is a side view of the clock construction of FIG. 3 and is taken in the direction of the arrows 4—4 of FIG. 3.

An electrical timer motor that is generally indicated by the reference numeral 90 in FIGS. 2, 3 and 4 is carried by the frame plate 36 and has an output shaft means 91 provided with a pinion gear 92 on the end thereof which is disposed in meshing relation with a pinion gear 93 carried by a shaft means 94 rotatably mounted in the frame means 21 and having a pinion 95 on the outer end thereof that is disposed in meshing relation with a pinion gear 96 fixed on a shaft means 97 that is rotatably mounted in suitable openings 98 and 99 in the frame members 35 and 36 as illustrated in FIG. 8.

The shaft means 97 has a pair of pinion gears 100 and 101 rotatably mounted thereon and being respectively disposed between washer means 102 and 103 with the outer washer means 102 being disposed against a shoulder 104 of the shaft 97 while the outer washer 103 is disposed against a bushing 105 disposed between the outer washer 103 and the side 82 of the frame 36.

A bowed spring member 106, similar to the spring member 84 previously described, has an opening 107 through the middle thereof that telescopically receives the shaft member 97 therethrough whereby the opposed ends 108 of the spring member bear against the gear 96 and the medial portion 109 thereof bears against the washer 103 to the left of the pinion 101. Since the gear 96 has a rectangular opening 110 passing therethrough and receiving a similarly shaped portion 111 of the shaft 97 therein, the gear 96 rotates in unison with the shaft 97 but is axially movable thereon so that the outward compression force of the spring member 106 tends to cause the pinions 100 and 101 to rotate in unison with the gear 96 since the same are being axially moved outwardly against the outer washers 102 and 103 and, thus, outwardly against the shoulder 104 of the shaft 97 and the busing 105. However, should an opposing force be imposed upon either pinion gear 100 or 101 in a manner hereinafter set forth, the same can be rotated relative to the gear 96 as the spring member 106 acts as a clutch means whereby the spring 106 comprises a clutch means between the gear 96 and the pinion 100 and a clutch means between the gear 96 and the pinion 101 for a purpose hereinafter set forth.

The minute gear 52 that is carried by the minute sleeve 48 is disposed in meshing relation with the pinion 100 while the teeth 67 of the cam 61 are adapted to be disposed in meshing relation with the pinion 101 when the cam 61 has the teeth 67 rotated in a manner to be moved into meshing relation with the pinion 101 which takes place whenever the pointer 26 thereof has been set into a timed position other than at the "0" position thereof or the "OFF" position thereof since in those positions of the pointer 26, the untoothed portion 68 of the cam member 61 is disposed adjacent the pinion 101.

Thus, as long as the electric motor 90 is interconnected to a power source (not shown), the motor 90 rotates the gear 92 on the output shaft 91 thereof which through the gear 93 and pinion 95 continuously drives the gear 96 and shaft means 97 so that the pinion 100 will normally drive the minute gear 52 and thereby rotate the minute sleeve 48 to continuously move the minute hand 29 relative to the time of day scale 27 in a proper time manner.

The pinion 53 of the minute sleeve 48 is disposed in meshing relation with a gear 112 fixed to a shaft 113 that is rotatably carried by the frame plates 35 and 36 and has a pinion gear 114 fixed thereto and disposed in meshing relation with the hour gear 60 so as to drive the hour sleeve 54 and thereby move the hour hand 28 relative to the time of day scale 27 in the proper time manner with the minute hand 29.

Thus, it can be seen that the rotation of the minute wheel 52 causes the pinion 53 of the minute sleeve 48 to rotate the gear 112 and through the pinion 114 drive the hour gear 60.

However, when a person desired to set the time of day clock 23 to another setting thereof, that person pushes axially inwardly on the selector shaft means 30 to couple the spline projections 88 and spline notches 89 together so that subsequent rotation of the selector shaft means 30 in the in axial condition illustrated in FIG. 9 causes the minute sleeve 48 and its gear 52 to rotate and thus rotate the pinion 100 that is disposed in meshing relation with the gear 52 relative to the rotating gear 96 on the shaft 97 and permit such setting of the minute sleeve 48 and, thus, the minute hand 29 and through the meshing relation of the gear 53 and gears 112, 114 and 60 to also set the hour hand 29 in a proper time manner therewith.

Figure 5:
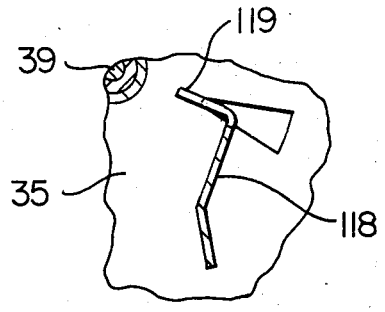
FIG. 5 is a fragmentary cross-sectional view taken on line 5—5 of FIG. 4.

A plurality of metallic pole members 115 of the electric motor 90 are carried by post means 116 in a conventional manner and are adapted to operate or vibrate an end 117 of a metallic alarm member 118 that is pivotally mounted to the frame members 35 and 36 by knife edge means 119 and 120 as illustrated in FIGS. 4 and 5. The alarm end 117 of the alarm member 118 is normally pivotally urged toward the surface means 121 of the pole members 115 by a coil compression spring 122 having one end 123 disposed against a bracket member 124 of the frame 21 and the other end 125 thereof bearing against an arm 126 of the alarm member 118.

Figure 6:
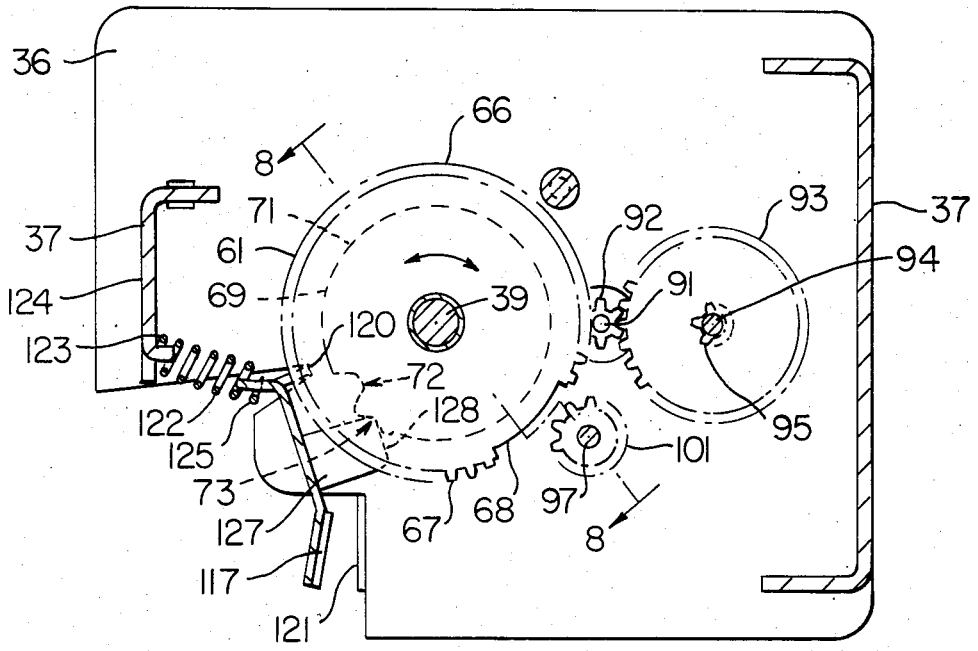
FIG. 6 is a fragmentary cross-sectional view taken on line 6—6 of FIG. 2.
Figure 7:
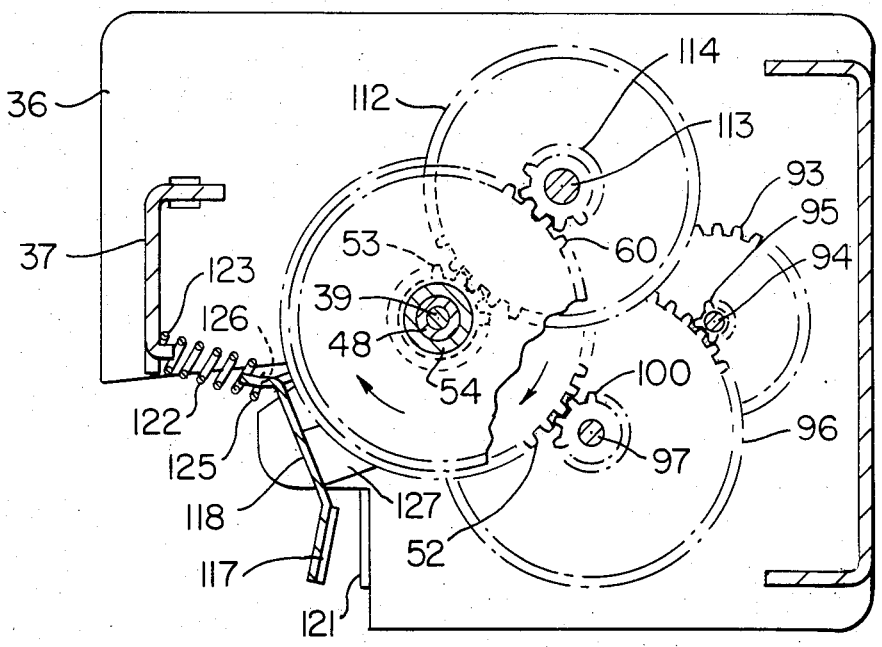
FIG. 7 is a cross-sectional view taken on line 7—7 of FIG. 2.

However, the alarm member 118 has a tongue 127 provided with an end 128 that bears against the cam surface 71 of the tubular cam section 69 of the cam member 61 so that when the same is against the cam surface 71 as illustrated in FIG. 14 or is in the notch 73 as illustrated in FIGS. 6 and 10, the alarm end 117 is held away from the surface means 121 of the pole means 115 and will not vibrate thereagainst so as to be sounding an alarm. It is only when the surface 128 of the tongue 127 is received in the large cutout 72 in the peripheral surface 71 of the cam member 61 that the spring 122 is adapted to pivot the alarm member 118 so that the end 117 thereof is disposed against the pole piece surface means 121 and will be vibrated thereagainst so as to be sounding an alarm in a manner well known in the interval timer art, such alarm sounding condition of the alarm member 118 taking place only when the interval timer means 22 has its pointer 26 disposed at the "0" position thereof as illustrated in FIG. 15.

However, when the operator turns the control knob 31 of the selector shaft means 30 so as to position the pointer 26 at the "OFF" position thereof as illustrated in FIGS. 1, 6 and 10, the end 128 of the tongue 127 is forced outwardly into the small notch 73 so that the arm 118 is pivoted outwardly against the force of the compression spring 122 to move the alarm end 117 thereof away from the surface means 121 of the pole means 115 so that the alarm member 118 cannot be vibrated thereby to sound its alarm.

Therefore, it can be seen that the clock construction 20 of this invention can be formed of the various parts previously described by the method of this invention to operate in a manner now to be described.

When the electric motor 90 is interconnected to a suitable power source (not shown), the same continuously drives the output gear 92 and through the gear means 93 and 95 continuously drives the gear 96 and shaft means 97 which through the clutch spring 106 continuously drives the pinions 100 and 101, the pinion 100 driving the minute gear 52 and, thus, the minute sleeve 48 to continuously move the minute hand relative to the time of day scale 27. Rotation of the minute sleeve 48 and its pinion 53 drives the pinion 112, the shaft 113 and the pinion 114 that is disposed in meshing relation with the hour gear 60 so that the hour gear 60 rotates and rotates the hour sleeve 54 and, thus, the hour hand 28 relative to the time of day scale 27 whereby the time of day clock means 23 provides a visual indication of the time of day.

Should the operator desire to set the time of day clock means 23 to a new setting thereof, such as for the purpose of correcting the time setting thereof to the actual time, the operator pushes axially inwardly on the control knob 31 to axially move the selector shaft means 30 inwardly from the position illustrated in FIG. 8 to the position in FIG. 9 to couple the spline projections 88 of the selector shaft means 30 to the spline notches 89 of the minute sleeve 48 so that subsequent rotation of the control knob 31 in either a clockwise direction or a counter clockwise direction causes the minute sleeve 48 and its gear 52 to be rotated and rotate the pinion 100 relative to the driving gear 96 because of the previously described clutch operation provided by the spring 106 so that the minute hand 29 can be set to the desired position thereof and through the rotation of the pinion 53 of the minute sleeve 48 meshing with the gear 112 and the gear 114 meshing with the hour gear 60, the hour sleeve 54 and its hour hand 28 is likewise being adjusted by the rotation of the selector shaft means 30 while in its in axial position of FIG. 9.

Once the time of day clock means 23 has been adjusted to the desired time setting thereof, a releasing of the selector shaft means 30 causes the bowed spring member 84 to expand from the condition illustrated in FIG. 9 to the condition illustrated in FIG. 8 and thereby move the selector shaft means 30 to its out axial position where the spline means 88 and 89 are out of engagement with each other.

When the operator desires to set the interval timer means 22, the operator grasps the control knob 31 and rotates the selector shaft means 30 while in its axial out position of FIG. 8 in either a clockwise or counterclockwise direction to cause the pointer 26 thereof to be positioned against the desired number on the interval timer scale 24 to correspond to the desired interval time that the timer means 22 is to provide, such as 30 minutes as illustrated in FIG. 14. Such rotation of the selector shaft means 30 causes a like rotation of the cam member 61 and causes its teeth 67 to come into meshing relation with the pinion 101 and cause the pinion 101 to rotate therewith relative to the drive gear 96 through the clutch spring 106 as previously described so that the pinion 101 is disposed in meshing relation with a certain portion of the gear teeth 67 as illustrated in FIG. 14. It can also be seen that at this time the tongue end 128 of the tongue 127 of the alarm arm 118 is held outwardly against the cam surface 71 so that the alarm end 117 is still disposed away from the pole surface means 121. Once the control knob 31 is released, the pinion 101 now again rotates with the shaft 97 that is being rotated by the drive gear 96 and through its meshing relation with the teeth 67 of the cam member 61 causes the cam member 61 to rotate and thus the selector shaft means 30 to rotate in unison therewith as the drive member 77 is driven by the slot means 74 of the tubular cam part 69. Rotation of the selector shaft means 30 causes rotation of the pointer 26 therewith and the same is driven back toward the "0" position thereof after the selected 30 minutes has elapsed. At this time, it can be seen in FIG. 15 that the end 128 of the tongue 127 of the alarm member 118 is received in the large cutout 72 of the surface 71 of the cam means 61 so that the alarm end 117 is pivoted against the pole surface means 121 by the spring 122 and is vibrated thereagainst to sound the alarm that the selected time period of the interval timer means 22 has elapsed. At this time, the alarm signal will continue to operate until the operator grasps the control knob 31 and further rotates the selector shaft means 30 so as to position the pointer 26 against the "OFF" position as illustrated in FIG. 1 which causes the tongue 127 to be cammed outwardly and placed in the locking off cam notch 73 as illustrated in FIGS. 6 and 10. Such position of the selector shaft means 30 causes the alarm member 118 to have the end 117 thereof held away from the pole surface means 121 so that the alarm member 118 can no longer sound an alarm.

Therefore, it can be seen that this invention not only provides a new clock construction, but also this invention provides a new method of making such a clock construction.

While the forms and methods of this invention now preferred have been illustrated and described as required by the Patent Statute, it is to be understood that other forms and method steps can be utilized and still fall within the scope of the appended claims wherein each claim sets forth what is believed to be known in each claim prior to this invention in the portion of each claim that is disposed before the terms "the improvement" and sets forth what is believed to be new in each claim according to this invention in the portion of each claim that is disposed after the terms "the improvement" whereby it is believed that each claim sets forth a novel, useful and unobvious invention within the purview of the Patent Statute.

What is claimed is:

1. In a clock construction comprising a frame means, an interval timer means carried by said frame means, and a selector shaft means rotatably carried by said frame means while being axially movable relative thereto and having interconnection means operatively interconnected to said timer means to set the same to a selected time period upon rotation of said selector shaft means, said timer means comprising a cam member rotatably disposed on said shaft means and having a drive slot means in one side thereof, said interconnection means of said shaft means comprising a drive member carried thereby and being disposed in said slot means to rotate said cam member in unison with rotation of said shaft means in any axial position of said shaft means, and spring means disposed between said frame means and said drive member to tend to maintain said shaft means in one axial position thereof, the improvement wherein said cam member and said spring means are so constructed and arranged that said spring means is confined completely within said slot means of said cam member in all axial positions of said shaft means relative to said frame means.

2. A clock construction as set forth in claim 1 wherein said spring means comprises a bowed spring member.

3. A clock construction as set forth in claim 2 wherein said bowed spring member has an opening passing therethrough and receiving said shaft means therethrough.

4. A clock construction as set forth in claim 3 wherein said bowed spring member has opposed ends and an arcuate medial portion between said opposed ends thereof, said opening passing through the middle of said medial portion.

5. A clock construction as set forth in claim 4 wherein said slot means has a certain peripheral configuration, said drive member and said bowed spring member respectively having peripheral configurations substantially the same as said certain peripheral configuration.

6. A clock construction as set forth in claim 5 wherein said bowed spring member has said medial portion thereof engaging against said force means.

7. A clock construction as set forth in claim 6 wherein said frame means has a portion thereof extending into said slot means and comprising the part thereof that is engaged by said medial portion of said bowed spring member.

8. In a clock construction comprising a frame means, a time of day clock means carried by said frame means, an interval timer means carried by said frame means, and a single selector shaft means rotatably carried by said frame means while being axially movable relative thereto and having first interconnection means operatively interconnected to said timer means to set the same to a selected time period upon rotation of said selector shaft means and second interconnection means operatively interconnected to said clock means to set the time thereof upon rotation of said selector shaft means while in a certain axial position thereof, said timer means comprising a cam member rotatably disposed on said shaft means and having a drive slot means in one side thereof, said first interconnection means of said shaft means comprising a drive member carried thereby and being disposed in said slot means to rotate said cam member in unison with rotation of said shaft means in any axial position of said shaft means, and spring means disposed between said frame means and said drive member to tend to maintain said shaft means in one axial position thereof, the improvement wherein said cam member and said spring means are so constructed and arranged that said spring means is confined completely within said slot means of said cam member in all axial positions of said shaft means relative to said frame means.

9. A clock construction as set forth in claim 8 wherein said spring means comprises a bowed spring member.

10. A clock construction as set forth in claim 9 wherein said bowed spring member has an opening passing therethrough and receiving said shaft means therethrough.

11. A clock construction as set forth in claim 10 wherein said bowed spring member has opposed ends and an arcuate medial portion between said opposed ends thereof, said opening passing through the middle of said medial portion.

12. A clock construction as set forth in claim 11 wherein said slot means has a certain peripheral configuration, said drive member and said bowed spring member respectively having peripheral configurations substantially the same as said certain peripheral configuration.

13. A clock construction as set forth in claim 12 wherein said bowed spring member has said medial portion thereof engaging against said frame means.

14. A clock construction as set forth in claim 13 wherein said frame means has a portion thereof extending into said slot means and comprising the part thereof that is engaged by said medial portion of said bowed spring member.

15. In a method of making a clock construction comprising the steps of providing a frame means, forming an interval timer means to be carried by said frame means, forming a selector shaft means to be rotatably carried by said frame means while being axially movable relative thereto, operatively interconnecting interconnection means of said shaft means to said timer means to set the same to a selected time period upon rotation of said selector shaft means, forming said timer means to comprise a cam member rotatably disposed on said shaft means and having a drive slot means in one side thereof, forming said interconnection means of said shaft means to comprise a drive member carried thereby and be disposed in said slot means to rotate said cam member in unison with rotation of said shaft means in any axial position of said shaft means, and disposing spring means between said frame means and said drive member to tend to maintain said shaft means in one axial position thereof, the improvement comprising the step of forming said cam member and said spring means to be so constructed and arranged that said spring means is confined completely within said slot means of said cam member in all axial positions of said shaft means relative to said frame means.

16. A method of making a clock construction as set forth in claim 15 and including the step of forming said spring means to comprise a bowed spring member.

17. A method of making a clock construction as set forth in claim 16 and including the step of forming said bowed spring member to have an opening passing therethrough and receiving said shaft means therethrough.

18. A method of making a clock construction as set forth in claim 17 and including the step of forming said bowed spring member to have opposed ends and an accurate medial portion between said opposed ends thereof, said opening being formed through the middle of said medial portion.

19. A method of making a clock construction as set forth in claim 18 and including the step of disposing said bowed spring member so that said mdial portion thereof engages against said frame means.

20. A method of making a clock construction as set forth in claim 19 and including the step of forming said frame means to have a portion thereof extending into said slot means and comprising the part thereof that is engaged by said medial portion of said bowed spring member.

21. A clock construction as set forth in claim 1 wherein said spring means rotates substantially in unison with said cam member relative to said shaft means.

22. A clock construction as set forth in claim 21 wherein said slot means of said cam member and said spring means are disposed in interconnected relation whereby said slot means drives said spring means as said cam member is rotated by said drive member so that said spring means rotates substantially in unison with said cam member.

23. A clock construction as set forth in claim 8 wherein said spring means rotates substantially in unison with said cam member relative to said shaft means.

24. A clock construction as set forth in claim 23 wherein said slot means of said cam member and said spring means are disposed in interconnected relation whereby said slot means drives said spring means as said cam member is rotated by said drive member so that said spring means rotates substantially in unison with said cam member.

25. A method of making a clock construction as set forth in claim 15 and including the step of forming said spring means to rotate substantially in unison with said cam member relative to said shaft means.

26. A method of making a clock construction as set forth in claim 25 and including the step of disposing said slot means of said cam member and said spring means in interconnected relation whereby said slot means drives said spring means as said cam member is rotated by said drive member so that said spring means rotates substantially in unison with said cam member.

* * * * *